US006131702A

United States Patent [19]

Berridge

[11] Patent Number: 6,131,702

[45] Date of Patent: Oct. 17, 2000

[54] HOME PLATFORM LIFT FOR ATTACHED GARAGES

[76] Inventor: Harold Arthur Berridge, 2318 Berdan Ave., Toledo, Ohio 43613

[21] Appl. No.: 09/086,896

[22] Filed: May 29, 1998

[51] Int. Cl.[7] ..... B66B 11/00

[52] U.S. Cl. ..... 187/259; 187/336

[58] Field of Search ..... 187/258, 259, 187/256, 266, 414, 901, 401, 336, 342; 312/247, 246

[56] References Cited

U.S. PATENT DOCUMENTS 1,270,716 6/1918 Flannery ..... 187/259
4,412,601 11/1983 Cooper ..... 187/27
5,535,852 7/1996 Bishop et al. ..... 187/336

*Primary Examiner*—Kenneth W. Noland

[57] ABSTRACT

A platform lift communicates between a garage floor and the floor of the attic space above. At the upper level, means are provided so the platform lift seals with the ceiling and functions as part of the ceiling while in its uppermost position. Electric power to turn the respective lift shafts is used to urge the lift strands which circle under the platform pulley wheels located within the corners of the platform. The respective strands are collected or released from the lift cranes on the floor above. Each crane has a wind spool driven by the respective rotary transmission coupled to an electric motor through reduction gears. All power to the lift is wired in common through an operable reversible constant-off switch.

10 Claims, 5 Drawing Sheets

Fig. 6-A
106
122
42
120
102
102
104
114
108
92
42
38
108
42
118
92
72
74
70
112
110
38
76
52
38
106
104
108
118
42
94
104
92
100
86
80
24
98
96
116
16
100
94
86
118
96
90

HOME PLATFORM LIFT FOR ATTACHED GARAGES

BACKGROUND OF THE INVENTION

This invention relates in general to a platform lift for use in single unit homes having attached garages with an attic or bonus room above the garage.

In the past storage and retrieval of a wide spectrum of things and materials between home garages and the overlying attic areas have depended largely on access holes and fold down attic ladders.

The overhead attic access hole through which a ladder could pass enabled the storage/retrieval of things in a very limited way as demanded by the clearance dimensions of the hole. Such access was and is clumsy at best.

Overhead fold down attic ladders were a great improvement but still quite restrictive as to what could be stored and retrieved. The awkwardness of using a ladder with item being transferred in hand was still there. Physical risks of falling, twisting, and strain injuries went with this usage.

A third option to storing a miscellany of things, tools, and sports items is often accomplished in suburban homes by the trail of least resistance. This meant stacking or putting many items on the garage floor. The result of this sometimes prevented keeping a family car in the garage. Today some homes are being built with extra car stall space to be used in keeping a miscellany of things under roof.

Inventions that go beyond the ladder/access hole mode of storage/retrieval do not seem to apply to the spectrum of things which can be or are moved between home attached garages and attics. The mechanical inventions for use in home garages include a boat storage apparatus and an auto hoist.

The car hoist U.S. Pat. No. 2,349,389 (1944) by Thompson is very specific in its use and does not seem to have application as envisioned here.

The Henderson Auxiliary Storage Means for Boats and the Like, U.S. Pat. No. 3,556,320 (1971) is for garage use. This storage means does not have provisions or intent in solving the storage/retrieval of anything other than boat-like objects. Further, this device is intended to be occupied continuously in suspending an object. Through its use, occupation or nonuse the gaping portal is there. Mechanically this storage means appears to be little more than a block and tackle rigged to a ridge beam requiring some trial and error in lift strap placements to use effectively. Provisions are not made for storing much of a range of items beyond boat-like things.

SUMMARY OF THE INVENTION

Accordingly, the review of the prior art and contrasting it to this invention a number of objectives and advantages are:

(a) a reduction of the physical impediment to items moved between garage and attic by using a predetermined portal access;

(b) to provide a platform lift suited to its portal and capable of moving a wide spectrum of items commonly stored in garages and their attendant overhead spaces;

(c) to provide a platform lift that is easy to use;

(d) to provide a platform lift that is stable in operation;

(e) to provide a platform lift that affords the operator good visibility of the lift and lift portal from the control switches, (f) to provide a platform lift that can seal and insulate the overhead room from the garage when in its zenith position within its portal;

(g) to provide a platform lift with backup support for home use;

(h) to provide a reasonably priced home utility lift adaptable to current home storage/retrieval problems;

(i) to provide a platform lift unencumbered by a lift shaft.

Further objects and advantages are to provide a platform lift that aesthetically minimizes the portal's presence while the system enables people to put garage space back to use as garage space. Also, the ease of item transfers to and from the attic bonus room could make repair and maintenance work more pleasant within the controlled environment of the attic room.

Tertiary uses of the bonus room attic as a finished, environmentally controlled shop/storage work area shall have taken on a new dimension with the advent of this invention.

Various objects and advantages of this invention will become apparent to those skilled in the art from the following detailed description of the preferred embodiment, when read in light of the accompanying drawings.

BRIEF DESCRIPTION OF THE DRAWINGS

FIG. 6A shows an expanded view of the wind guide mechanism.

REFERENCE NUMERALS

Figure 1:
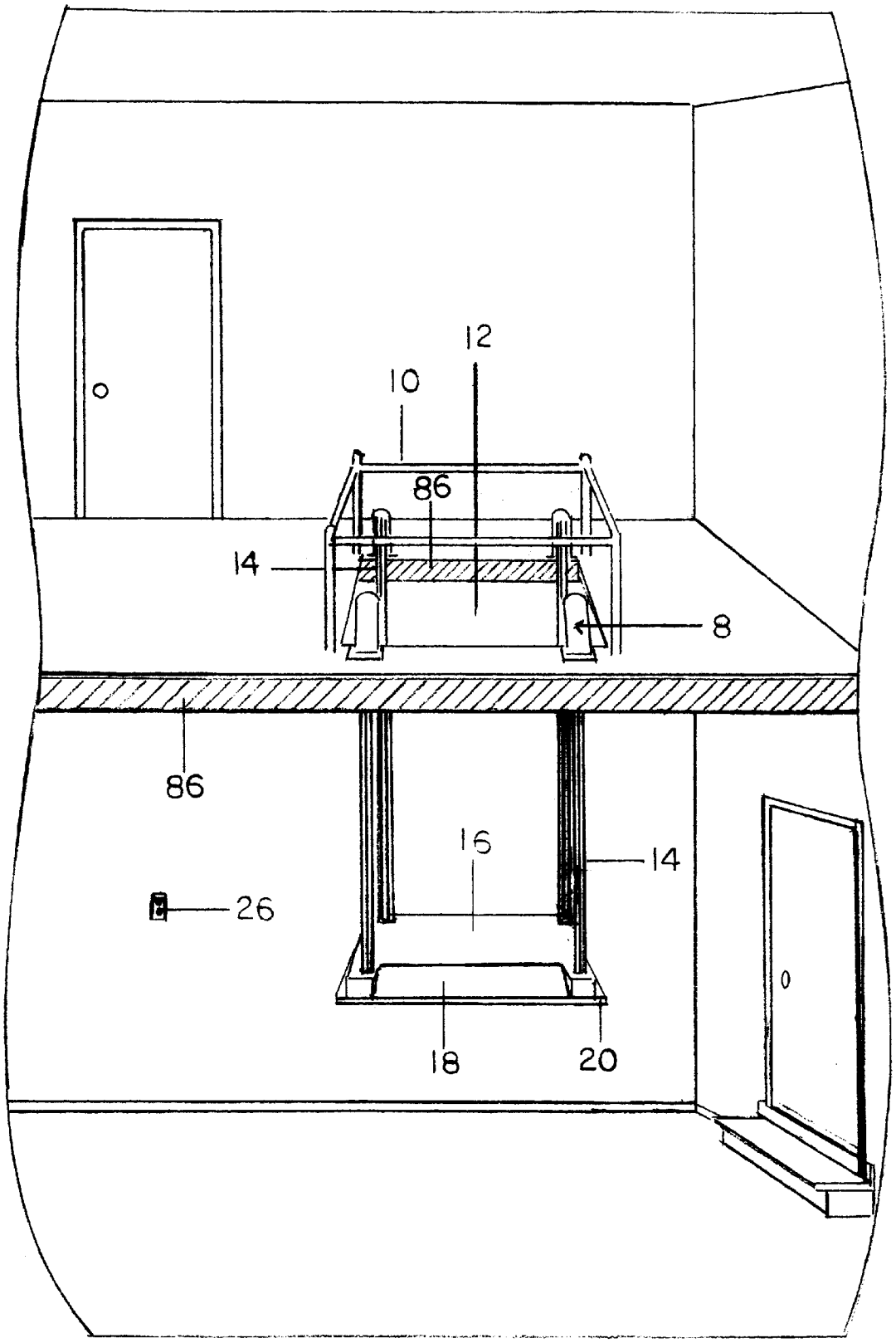
FIG. 1 is an overview showing how the lift communicates between the garage floor and attic room through its portal.

| | |
|---|---|
| 8 integrated crane | 10 portal railing |
| 12 portal | 14 lift strand (webbing) |
| 15 steel cable | 16 lift platform surface |
| 18 ramp | 20 wood molding |
| 21 platform molding (rubber) | 22 ceiling molding (rubber) |
| 23 molding bonding surface | 24 strand port |
| 26 control switches | 28 crane frame side |
| 30 frame base | 32 drive mount plate |
| 34 webbing bar | 36 webbing bar receptacle |
| 38 bearing block | 40 lift gear |
| 42 wind spool | 43 spool flange |
| 44 concave webbing channel | 46 webbing pin |
| 48 pin loop | 52 lift shaft |
| 54 frame ties | 56 tie weld tabs |
| 58 webbing clamp | 60 access plate |
| 62 access fasteners | 64 drive mount holes |
| 66 key | 70 reduction gears |
| 72 motor | 74 brake |
| 76 drive spur | 78 platform axle |
| 80 platform pulley wheel | 82 wood framing |
| 84 bearing | 86 joist |
| 88 webbing redundancy | 90 pipe fabrication |
| 92 lift shaft supports | 94 crane pulley |
| 96 idler bearing | 98 cable retainer |

-continued

| REFERENCE NUMERALS | |
|---|---|
| 100 steel cable | 102 cam groove |
| 104 wind guide (casting) | 106 cable slot |
| 108 stabilizer bar | 110 transmission box |
| 112 coupler | 114 lube fitting |
| 116 idler support (welded pipe) | 118 crane |
| 120 knuckle | 122 guide arm |

DETAILED DESCRIPTION OF THE PREFERRED EMBODIMENT

An overview of this platform lift is shown in FIG. 1. A platform, 16, is run up and down by redundant supporting lift strands, 14, through the operation of the respective integrated lift cranes, 8. All four cranes and their rigging are alike. The platform, 16, seals the portal 12, in the ceiling when it is raised to its zenith position. The platform, 16, seals by contact of its perimeter rubber moldings, 21, attached to the periphery of the platform wood trim, 20, and the complementary rubber ceiling molding, 22, attached to the ceiling peripheral to the ceiling portal, 12. A cosmetic portal railing, 10, which may have one or more detachable rails, (not shown), is also seen in FIG. 1. The cranes, 8, shown in FIG. 1 are depicted generically with cosmetic plastic covers. The integrated crane is seen in detail in FIGS. 2–4 with its components. A ramp, 18, is shown on one end of the platform to facilitate loading heavy or rolling objects. The integrated cranes, 8, are individually electrically powered and wired in parallel through a digital constant off switch, 26. The platform, 16, is constructed of conventional wood framing and sheathing and fastened together with wood screws. The platform may be various dimensions of width and length and beefed up for a range of model capacities.

Figure 3:
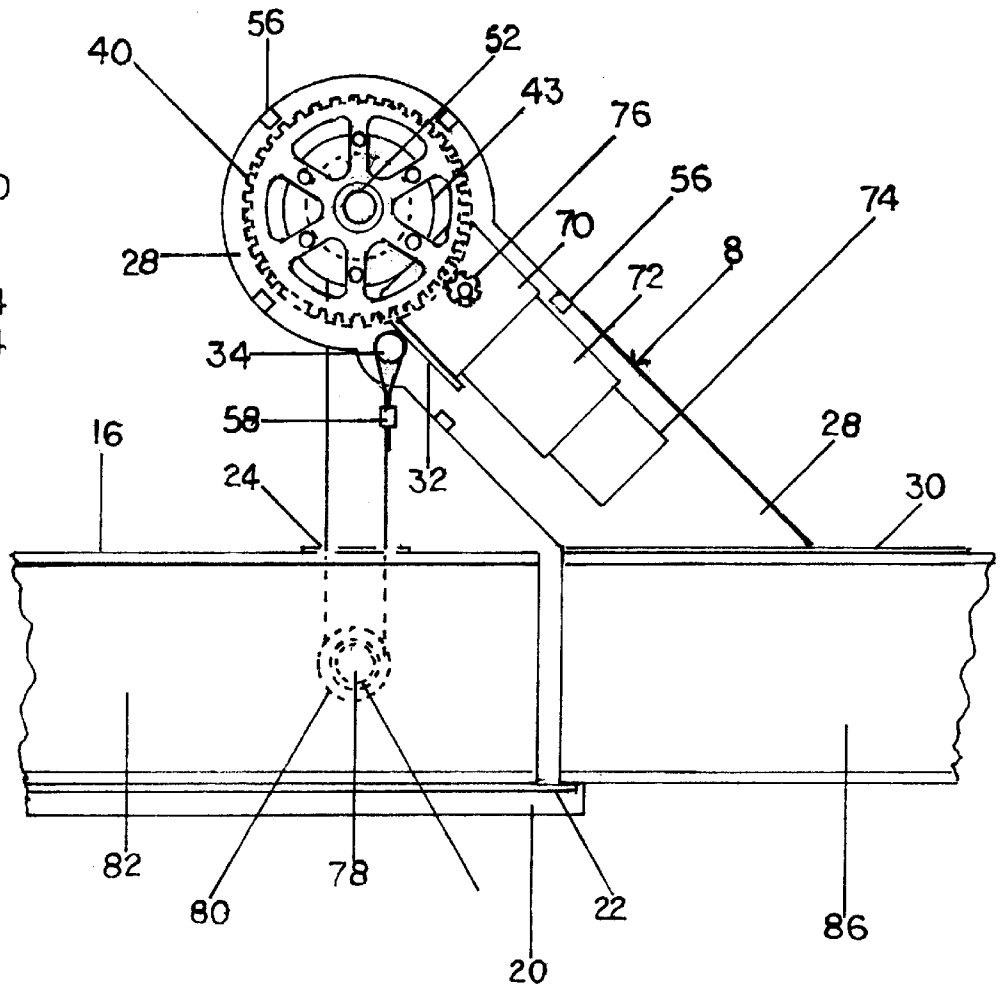
FIG. 3 is a side view of an integrated crane with the near side sheet metal frame removed for visibility of working parts.
Figure 2:
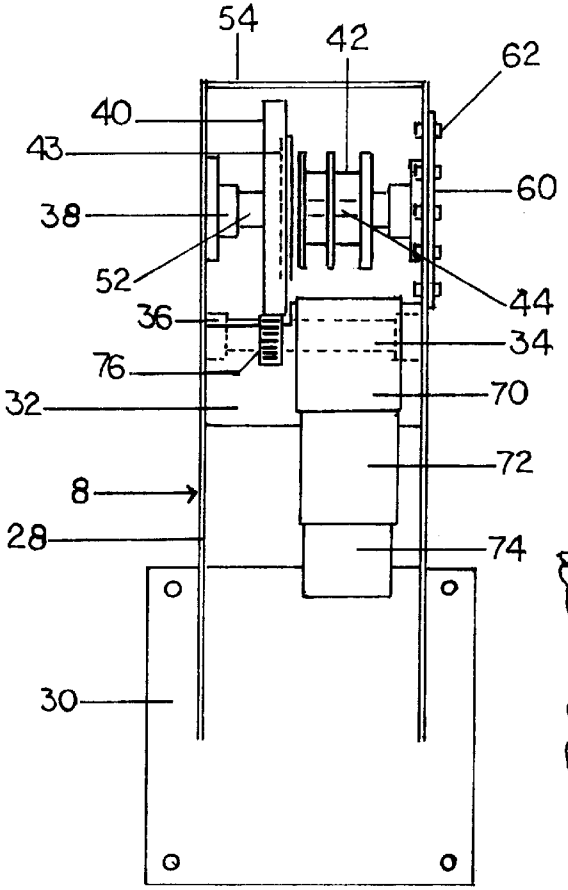
FIG. 2 is a top view of an integrated crane viewed at 90° to the rake angle.
Figure 4:
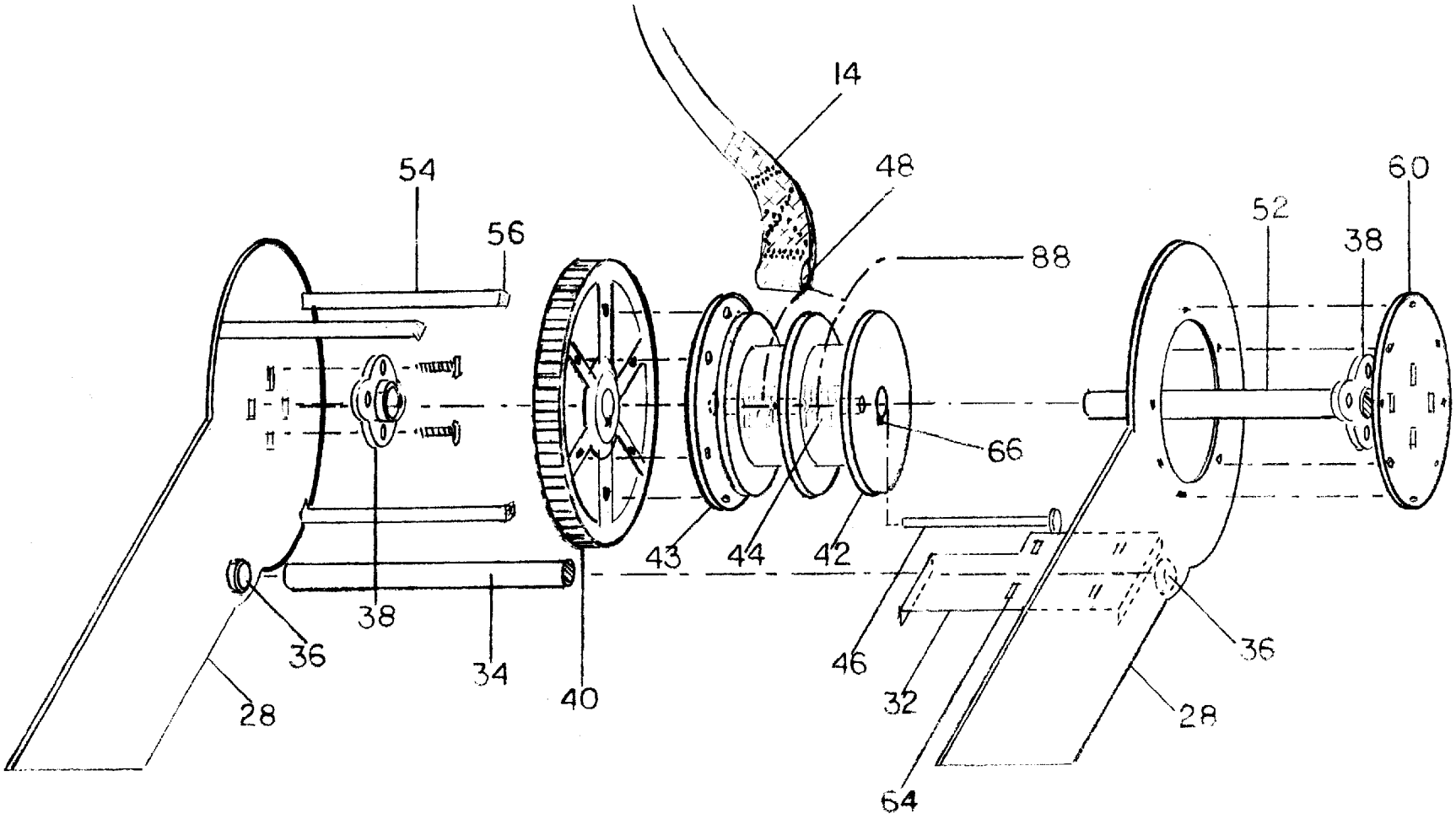
FIG. 4 is an exploded view of an integrated crane minus its electric motor, brake, the reduction gear box, and frame base.
Figure 5:
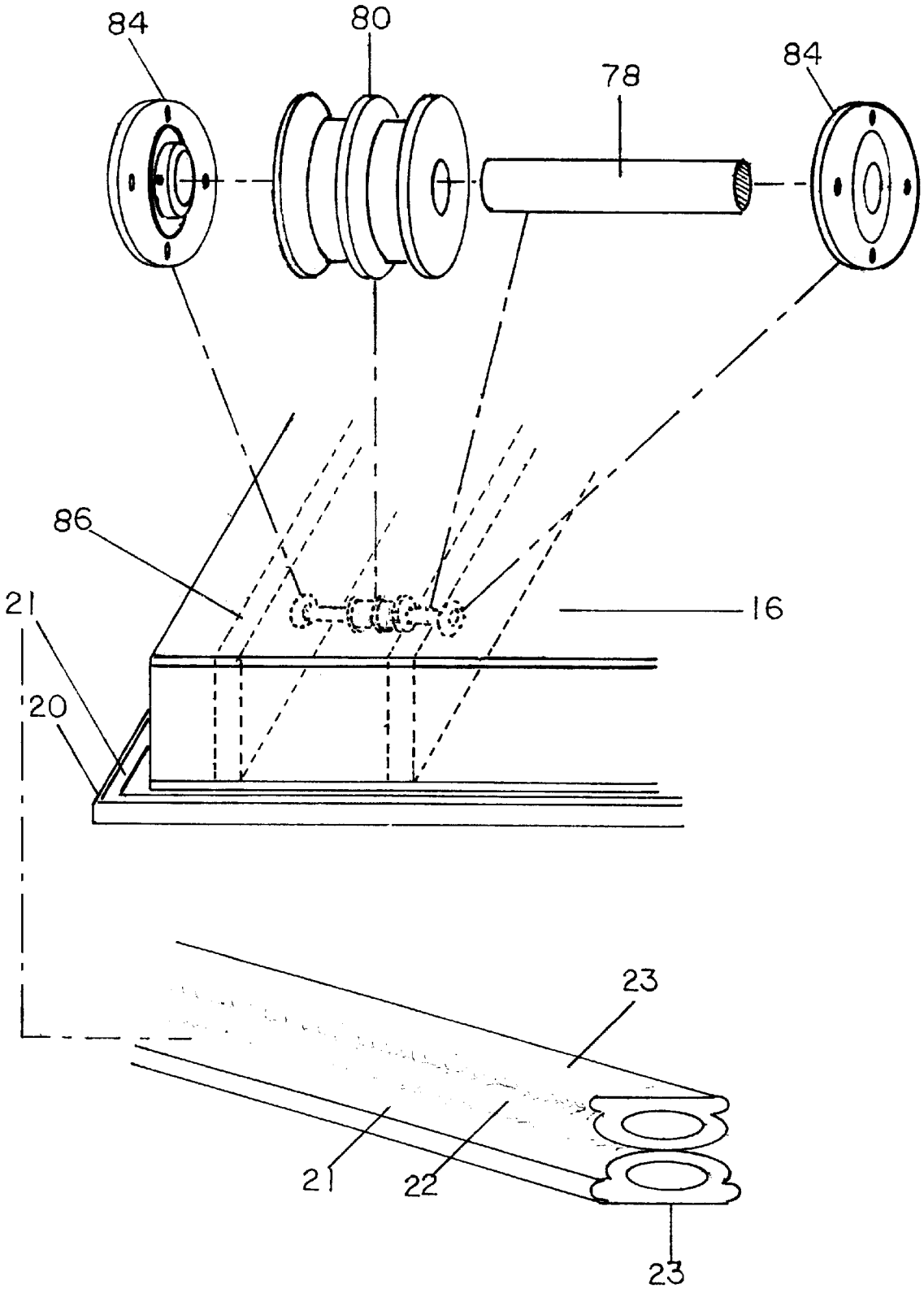
FIG. 5 shows an explosion drawing of the relationships of the pulley wheel assembly within a corner of the lift platform plus the attendant rubber moldings for platform lip and ceiling portal periphery.

A crane, 8, is an integral support and lift unit and each is composed of a frame, a power and rotary transmission system, and lift strands, 14, (webbing), in redundancy. As previously stated all four cranes are alike and designed to operate in consort and or load lifting. The crane frame is the rigid backbone of support for lifting. It also provides the points for mounting or attaching its components. The frame is of heavy gage sheet metal welded together. Each frame has two sides, a base, 30, and frame ties, 54. The frame ties are shown in FIG. 4 with a 90° bend on their ends called the tie weld tabs, 56. The frame is made with a rake angle of 45° to project out over the portal opening, 12, as it rises above its mounting on the attic floor. The crane frames, 30, are bolted to the attic floor through the floor joists. The frame is open both top and bottom to its rake angle of 45° and on its round upper end. The exception to this openness is where frame ties, 54, traverse between the frame sides. The frame access plate, 60, seen in FIGS. 2 and 4, bolt to the right side opposite the lift shaft, 52, and its components. The surface mount bearing block, 38, mounts to the access plate, 60, through the four slot shaped holes. It may be seen in FIG. 2 that the bearing blocks, 38, right and left are mounted to their respective sides of the frame for the purpose of securing the lift shaft, 52. The lift shaft, 52, is 1½inch diameter cold rolled steel. The lift shaft passes through the centers of the webbing spool, 42, and the lift gear, 40. Both the webbing spool, 42, and the lift gear, 40, are keyed, 66, into the lift shaft, 52. The webbing spool, 42, also bolts to the lift gear, 40. Bolts pass through the holes in the spool flange, 43, and through the mated opposing holes in the lift gear, 40. The webbing spool, 42, is cast steel. This spool is designed to wrap and unwrap the webbing, 42. The webbing spool details are seen in FIG. 4. It should be clear that dual, (redundant), webbing strands anchor onto the webbing spool, 42. A deeply concave webbing channel, 44, is seen on both sides of the redundant spool. The webbing pin, 46, passes through the right hand port, the pin loop, 48, the webbing, 14, and along the channel, 44, through the redundant loop and through the portal in the left end of the webbing spool, 42. The webbing pin, 46, is steel. The dual troughs of the spool are of equal widths to receive the webbing strands, 14, as the lift functions. These dimensions may be engineered for various webbing capacities and or lift capacities. Two other parts welded to the crane frame are the drive mount plate, 32, and the webbing bar receptacles, 36. They are best seen in FIG. 4. These receptacles, 36, are pipe sections welded to the frame sides so as to directly oppose each other. The webbing bar, 34, is seen in FIG. 2 and 3. The webbing bar, 34, spans between the frame sides and inserts into the receptacles, 36. The webbing bar, 34, seen on end in FIG. 3, supports one end of the redundant two strand pulley system.

The drive mount plate, 32, is just above the webbing bar, 34. The drive mount plate, 32, is a heavy sheet metal surface. It has slot shaped drive mount holes, to which the reduction gears, 70, the motor, 72, and the brake, 74, are secured. The secured position is one that brings into engagement the drive spur, 76, with the gear, 40. The drive spur, 76, runs off of the reduction gears output shaft. The parameters of this embodiment show a drive spur, 76, two inches in diameter, and a lift gear, 40, 12 inches in diameter.

The drive spur, 76, and the lift gear, 40, are also steel for strength and electrochemical compatibility. The gear teeth of lift gear, 40, are not shown in FIG. 2 so the hidden line of the spool flange, 43, may be seen.

The course of the duplicity of webbing strands, 14, leads from their point of attachment on the webbing bar, 34, through the strand port, 24, on the top surface of the lift platform. Thereafter, the lift strands, (webbing), continues downward around the dual channeled platform pulley wheel, 80. It then passes back up the opposite side of the platform pulley wheel, 80, and back out through the strand port, 24, on its respective side. The strand port, 24, is a stamped plate with in and out slots. Upon leaving the strand port the webbing ascends to the webbing spool, 42, mounted on the lift shaft, 52.

To operate the invention is easy, you merely depress one of two control switches, 26. The bottom button lowers the lift, the upper, wired to raise the lift platform, 16. A digital constant off switch, 26, may be supplied with facility for locking the switch. This would be an important safety back-up for the constant-off switch. The whole downward and upward course of the platform lift is to be manually controlled with the exception of the last moments of the upward travel to its "ceiling sealing bearing surfaces." Its travel in those last moments is interrupted by an automatic shut-off switch wired into the upward circuit loop, (not shown). The switch may be either a proximity switch or an electromechanical switch. Such a switch would prevent overrun and the damaging of the lift machinery. A proximity sensing switch may be placed on or within ceiling molding rubber around the ceiling periphery of the lift portal, 12.

The selection of appropriate switches with the reaction speeds/sensitivities matched to the travel rate or rates of respective models would be engineering considerations per model. The auto switch possibilities are many since the rate of lift travel is likely to be engineered in the slow 1½to 2½inch per second rate. For a lift height of 10 feet in the average garage this translates into a one-way trip time of between 1 minute and 20 seconds to 48 seconds respective to the 1½to 2½inch/second travel rates. Hence, the motor output in speed and torque, reducer gear ratios selected, and the ratios of the lift gear, 40, to the drive spur, 76, would require engineering for the desirable speed and the load range for a particular lift model.

In the illustration of the prior mentioned switching options we shall mentally place the lift platform, 16, at the top whereby the platform would seal the portal, 12. Depressing the bottom constant-off switch button electrically activates the release of the electric brakes, 74, and simultaneously acts on the motors to direct an unwinding of webbing strands, 14, from their respective webbing spools, 42.

The sequence of this energy transfer is traced from the initial torque of the motor shafts to the respective reduction gears, 70. Thus, the force is imparted to the drive spur, 76, on the reduction gears output shaft. The drive spur, 76, imputes the force to the lift gear, 40, which is fixed to both the lift shaft, 52, by a key, 66, and the webbing spool, 42, by bolts. The webbing spool, 42, is also key fixed to the lift shaft, 52. This is best seen in FIG. 4. The lift shaft, 52, to which the webbing spool, 42, and the lift gear, 40, are attached turns freely in its laterally placed bearing blocks, 38. The bearing blocks, 38, are bolted to the crane frame sides, 28.

The machinery of the crane frame, 8, functions to give up or retrieve 1 inch wide webbing strands, in duality, in a two strand support pulley lift system. Each of the 4 points of support in the platform represents a mechanical advantage of 2. Both ends of the platform supporting strands are anchored at designed anchorages within the respective crane frames, 8. Specifically, tracing the course of each supporting strand we locate the anchorage on the webbing spool, 42, follow it down and around the dual strand pulley wheel within the lift platform, 16, and back up to the anchorage of the opposite end on the webbing bar, 34. The webbing bar, 34, is fixed in its receptacles, 36, which are welded to the respective crane frame sides, 28.

The security of the webbing anchorages is achieved by webbing stitching on both ends. Additional securing back-up at the webbing bar, 34, is by the metal webbing clamp, 58. It is clamped Onto the webbing Just below the area of the loop stitching, FIG. 3. The opposite end of the webbing strand, 14, has a much smaller pin loop, 48, (FIG. 4), stitched into it to receive the loop locking webbing pin, 46. The unique cast steel webbing spool, 42, has two exposed deeply concave channels situated between the outer and middle flanges. The redundant strands, 88, (FIG. 4), fit into these channels and are locked in when the webbing pin, 46, is slid through the channel holes and both loops in the redundant webbing strands, 14.

Figure 6:
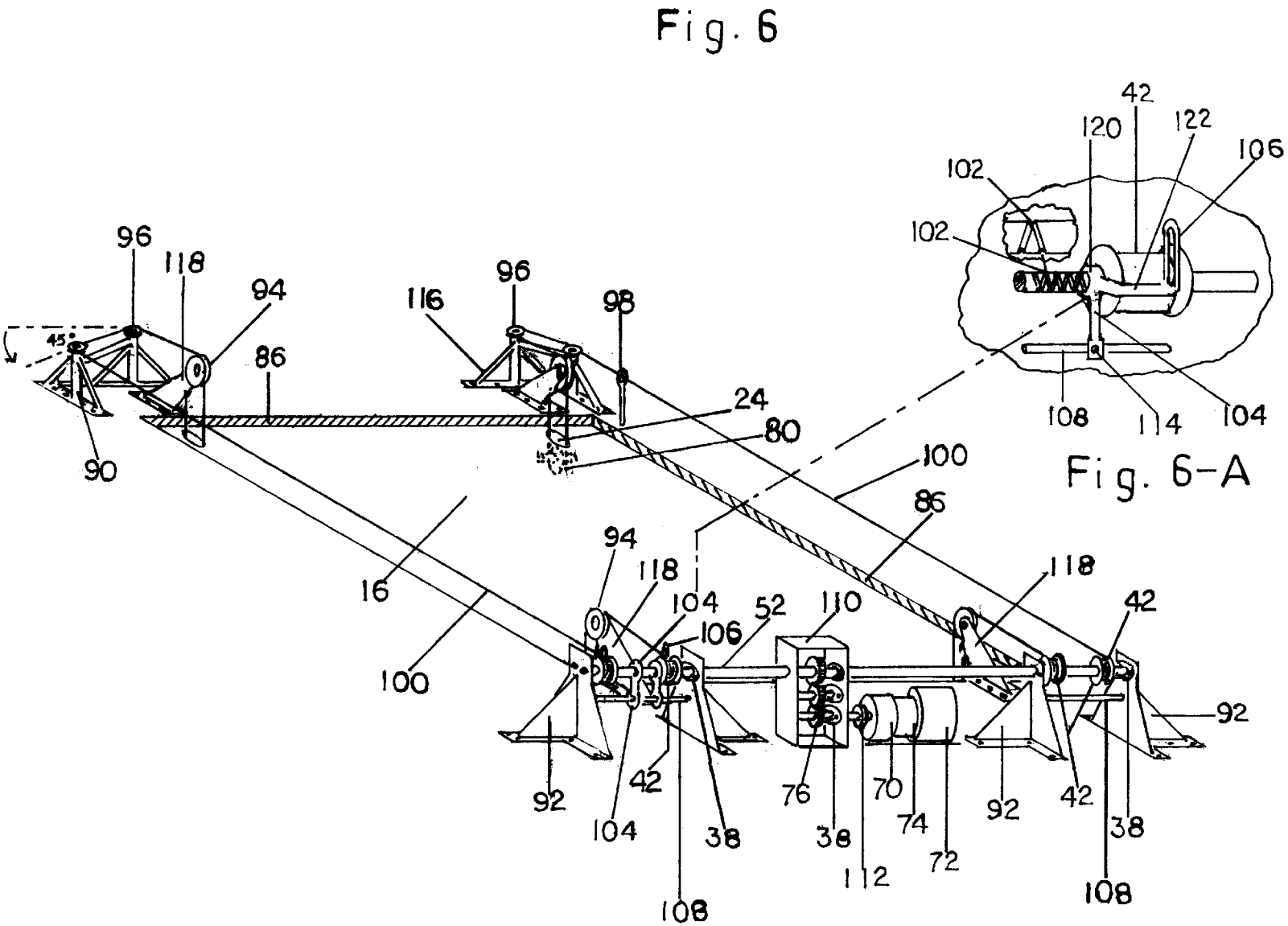
FIG. 6 shows an alternate embodiment of the invention with only one lift shaft.

An alternative embodiment of the invention is shown in FIG. 6. This embodiment varies from the earlier embodiment in having only one lift shaft, 52. The crane pulleys, or functioning cranes, 94, are remote to the rotary transmission, 110, and the motor, reduction gear, and brake, 72, 74, and 70 respectfully. Additionally, this system uses steel cables, 100, and cable redirecting means, 96 and 98. Ninety-six is an idler bearing and 98 is a cable retaining guide. The pipe fabricated structure, 116, supports the idlers, 96. Further, level winding wind guides, 104, directed by cams and cam followers act between the cam return grooves, 102, on the lift shaft, 52, and the complementing cam groove follower (not shown) located within the wind guide knuckle, 120. The lift shaft supports, 92, and the attendant bearing blocks, 38, are also seen to be a different arrangement. The integrated crane of the main embodiment has all of these functioning equivalents or in the case of the level winding mechanism is obviated.

The wind guide, 104, is a cast metal piece that has through knuckles bored for the wind shaft, 52, and the stabilizer bar, 108. It may be seen that the wind guide, 104, is composed of two cast appendages. One is directed vertically straight below the wind shaft knuckle, 120, and is anchored by the passage of the stabilizer bar through its knuckle. A grease fitting, 114, is also on this knuckle. The upper appendage of the wind guide casting, 104, has three offsets in three planes. The first advances the guide arm, 122, in front of the wind spool, 42, which is solidly anchored to the lift shaft, 52. The second offset goes horizontal and parallel to the face of the center of the wind spool, 42. The third offset rises vertically with its attendant cable slot, 106.

Knuckle, 120, of the wind guide, 104, which articulates with the lift shaft, 52, shall have a through hole from the superior center aspect of the knuckle (not shown) to its inner articulating surface in communication with the lift shaft, 52. Specifically, this through hole allows communication to the cam grooves, 102, by way of the cam follower.

The through hole to receive the cam follower, (not shown), in the guide arm knuckle, 120, is to be of two diameters into which the cam follower and its retaining screw will fit. The top portion of said hole is to be tapped for the retaining set screw. It is of larger diameter than the bottom of the hole where the cam follower penetrates into the cam grooves, 102, of the lift shaft, 52.

The lift shaft's, 52, four preselected displaced wind grooves, 102, each has return loops at the opposing ends of horizontal travel limits on the lift shaft, 52. The limit of the horizontal travel is preselected to the functioning limit of the wind spools widths, 42, and the accommodating horizontal offset of the guide arm, 122.

The above described level wind arm functions similar to a fishing reel.

In summary, the review of the drawings and specifications of this invention should make many of its advantages and potential utility clear. The inclusion into a home of such a platform lift makes storing and recovering stored items easy. It also opens up possibilities that previously would not or could not have been considered:

(1) it permits great ease of transfer between attic and garage floor of a wide range of things including tools, furniture, sports items, and boxed goods;

(2) it makes clearing and organizing valuable garage floor space a relatively easy task;

(3) the lift seals the ceiling portal so the environment of the room above may be maintained;

(4) the lift located in the garage ceiling makes for ready access for tools and sports items like bicycles to be moved into the attic room where repair work may be done in a more friendly, controlled environment;

(5) it affords potential for an alternate route of entry of furniture to the upper floor level.

Further, this invention has been created to wed the garage floor to the attic or bonus room floor level in homes having attached garages. The platform is molded at its underside edge so it will seal its peripheral underside edge to the garage ceiling access portal while raised.

The raising or lowering of the platform is done at four points by action of pulleys on the platform and respective overhead cranes. The cranes are mounted at the corners above the portal, and the cranes overhang the portal opening. Each of the powered cranes function to provide lifting/lowering force through support strands running between the crane pulleys and the platform pulleys.

As a prime safety feature redundancy of support is designed into each of the four support point's respective machinery.

The foregone specifications and descriptions of this invention should not be interpreted as limiting its breadth but as illustrations of some of the presently preferred embodiments.

Therefore, the scope of the invention should be determined by the appended claims and their legal equivalents rather than by the specifics and or examples given here.

What is claimed is:

1. A lift mechanism for transferring an object through a portal between an upper room and an underlying space, comprising:

a platform including a plurality of pulley wheel assemblies, each pulley wheel assembly including a duel channeled platform pulley wheel rotatably mounted to an axle;

a plurality of cranes, each crane including a motor, a gear mechanism operably coupled to the motor, and a plurality of duel channeled wind spools operably coupled to the gear mechanism; and a pair of lift strands, wherein a lift strand is received within a channel of the platform pulley wheel and a channel of the wind spool, and a redundant lift strand is received within a different channel of the platform pulley wheel and a different channel of the wind spool, wherein the pair of lift strands provide a redundant pulley system for transferring an object between the upper room and the underlying space.

2. The lift mechanism according to claim 1, wherein the platform includes a platform trim around a perimeter thereof, the platform trim including molding for mating contact with a molding around the perimeter of the portal to provide a seal between the upper room and the underlying space when the platform is placed in its zenith position.

3. The lift mechanism according to claim 1, wherein the gear mechanism comprises a reduction gear operably coupled to the motor, a drive spur operably coupled to the reduction gear, a lift gear operably coupled to the drive spur, and a lift shaft operably coupled to the lift gear and the duel channeled wind spool.

4. The lift mechanism according to claim 1, wherein the lift strand comprises webbing material.

5. The lift mechanism according to claim 1, wherein the motor is a reversible motor for raising and lower the platform between the upper room and the underlying space.

6. A lift mechanism for transferring an object between an upper room having a floor and an underlying space having a ceiling, comprising:

a platform;

a plurality of pulley wheels mounted to the platform, a plurality of crane pulleys mounted to the floor of the upper room;

a lift strand received within the plurality of pulley wheels and the plurality of crane pulleys;

a gear mechanism operably coupled to a motor;

a lift shaft operably coupled to the gear mechanism; and a pair of wind spools operably coupled to each end of the lift shaft, each wind spool including a wind guide, wherein the wind guide maintains the platform in a substantially horizontal position when the platform is raised or lowered between the upper room and the underlying space.

7. The lift mechanism according to claim 6, further including a cam and a cam follower for directing the wind guide.

8. The lift mechanism according to claim 7, further including an idler bearing arrangement at a distal end of the lift shaft for redirecting the lift strand.

9. The lift mechanism according to claim 6, wherein one or more of the plurality of crane pulleys are operably coupled to each wind spool.

10. The lift mechanism according to claim 6, wherein the lift strand comprises a cable.

* * * * *